US011085679B2

(12) United States Patent
Gariety et al.

(10) Patent No.: US 11,085,679 B2
(45) Date of Patent: Aug. 10, 2021

(54) LOW CHARGE DETECTION SYSTEM FOR COOLING SYSTEMS

(71) Applicant: Emerson Climate Technologies, Inc., Sidney, OH (US)

(72) Inventors: Mark Gariety, Covington, OH (US); Paul L. Fullenkamp, Versailles, OH (US); Fadi M. Alsaleem, Omaha, NE (US)

(73) Assignee: Emerson Climate Technologies, Inc., Sidney, OH (US)

( * ) Notice: Subject to any disclaimer, the term of this patent is extended or adjusted under 35 U.S.C. 154(b) by 0 days.

(21) Appl. No.: 16/799,156

(22) Filed: Feb. 24, 2020

(65) Prior Publication Data

US 2020/0191456 A1 Jun. 18, 2020

Related U.S. Application Data

(63) Continuation of application No. 15/878,927, filed on Jan. 24, 2018, now Pat. No. 10,571,171.

(Continued)

(51) Int. Cl.
*F25B 45/00* (2006.01)
*F25B 49/02* (2006.01)

(Continued)

(52) U.S. Cl.
CPC ..... *F25B 45/00* (2013.01); *F25B 13/00* (2013.01); *F25B 49/005* (2013.01); *F25B 49/02* (2013.01);

(Continued)

(58) Field of Classification Search
CPC ..... F25B 45/00; F25B 49/005; F25B 49/02; F25B 13/00; F25B 2700/2117;

(Continued)

(56) References Cited

U.S. PATENT DOCUMENTS 6,430,944 B1 8/2002 Ozawa
7,082,380 B2 * 7/2006 Wiebe ..... F25B 49/005 702/182

(Continued)

FOREIGN PATENT DOCUMENTS

EP 1965150 A1 9/2008

OTHER PUBLICATIONS

First Office Action regarding Chinese Patent Application No. 201880008978.9, dated Sep. 30, 2020. Translation provided by Unitalen Attorneys at Law.

(Continued)

*Primary Examiner* — Ana M Vazquez
(74) *Attorney, Agent, or Firm* — Harness, Dickey & Pierce, P.L.C.

(57) ABSTRACT

Systems and methods that detect a loss of charge associated with a climate controlled environment are described in the present disclosure. In various embodiments, a controller receives operating condition parameters associated with a climate-controlled environment. The controller determines whether a compressor is operating in a first mode of operation or a second mode of operation. The controller applies a first model to the operating condition parameters when the compressor is operating in the first mode of operation to represent a loss of charge associated with the climate-controlled environment and applies a second model to the operating condition parameters when the compressor is operating in the second mode of operation to represent the loss of charge associated with the climate-controlled environment.

20 Claims, 6 Drawing Sheets

Related U.S. Application Data

(60) Provisional application No. 62/451,406, filed on Jan. 27, 2017.

(51) Int. Cl.
*F25B 13/00* (2006.01)
*F25B 49/00* (2006.01)

(52) U.S. Cl.
CPC ..... *F25B 2500/19* (2013.01); *F25B 2500/222* (2013.01); *F25B 2700/04* (2013.01); *F25B 2700/2106* (2013.01); *F25B 2700/2116* (2013.01); *F25B 2700/2117* (2013.01); *F25B 2700/21152* (2013.01)

(58) Field of Classification Search
CPC .... F25B 2700/21152; F25B 2700/2116; F25B 2500/19; F25B 2500/222; F25B 2700/2106; F25B 2700/04; F25B 2700/21172
USPC ..... 62/77
See application file for complete search history.

(56) References Cited

U.S. PATENT DOCUMENTS

| | | | |
|---|---|---|---|
| 8,485,789 | B2 | 7/2013 | Gu et al. |
| 9,017,317 | B2 | 4/2015 | Ryba et al. |
| 2005/0126191 | A1 | 6/2005 | Lifson et al. |
| 2005/0262855 | A1 | 12/2005 | Hsieh et al. |
| 2006/0021362 | A1 | 2/2006 | Sadegh et al. |
| 2007/0151269 | A1 | 7/2007 | Crane et al. |
| 2011/0112814 | A1 | 5/2011 | Clark |

OTHER PUBLICATIONS

Supplementary European Search Report regarding European Patent Application No. 18744907.9, dated Jul. 29, 2020.
International Search Report of the ISA/KR regarding Internationl Application No. PCT/US2018/015491.
Written Opinion of the ISA/KR regarding International Application No. PCT/US2018/015491 dated Apr. 26, 2018.
Non-Final Office Action regarding U.S. Appl. No. 15/878,927 dated Jul. 18, 2019.
Notice of Allowance regarding U.S. Appl. No. 15/878,927 dated Oct. 25, 2019.

* cited by examiner

LOW CHARGE DETECTION SYSTEM FOR COOLING SYSTEMS

CROSS-REFERENCE TO RELATED APPLICATIONS

This application is a continuation of U.S. application Ser. No. 15/878,927, filed Jan. 24, 2018, which application claims the benefit of U.S. Provisional Application No. 62/451,406, filed on Jan. 27, 2017. The entire disclosures of the above applications are incorporated herein by reference.

FIELD

The present disclosure relates to refrigerant charge loss systems and methods and, more particularly, to systems and methods for detecting a refrigerant charge loss (e.g., loss of charge).

BACKGROUND

This section provides background information related to the present disclosure and is not necessarily prior art.

Refrigerant vapor compression systems can be utilized for refrigerating air supplied to a climate controlled environment to maintain temperature sensitive products, such as perishable/frozen products. Refrigerant vapor compression systems can also be utilized for transport refrigeration for refrigerating air supplied to the climate controlled environment.

SUMMARY

This section provides a general summary of the disclosure, and is not a comprehensive disclosure of its full scope or all of its features.

The present disclosure provides a system that includes a compressor and a controller. The controller receives operating condition parameters associated with a climate-controlled environment. The controller determines whether the compressor is operating in a first mode of operation or a second mode of operation. The controller applies a first model to the operating condition parameters when the compressor is operating in the first mode of operation to represent a loss of charge associated with the climate-controlled environment and applies a second model to the operating condition parameters when the compressor is operating in the second mode of operation to represent the loss of charge associated with the climate-controlled environment.

The present disclosure provides a system comprising a compressor and a controller that receives a plurality of operating condition parameters associated with a climate-controlled environment. The controller determines whether the compressor is operating in at least one of a first mode of operation corresponding to full capacity operation and a second mode of operation corresponding to partial capacity operation, applies a first model to the plurality of operating condition parameters when the compressor is operating in the first mode of operation to represent a loss of charge associated with the climate-controlled environment and applies a second model to the plurality of operating condition parameters when the compressor is operating in the second mode of operation to represent the loss of charge associated with the climate-controlled environment.

In some configurations, the loss of charge comprises at least one of a percentage of refrigerant charge loss and an estimated modulation percentage of the compressor.

In some configurations, the controller determines whether the loss of charge exceeds a predefined threshold, and generates an alert indicating the loss of charge when the loss of charge exceeds the predefined threshold.

In some configurations, the first model is a function of an evaporator temperature of an evaporator associated with the climate-controlled environment.

In some configurations, the first model is a function of a supply air temperature of supply air associated with the climate-controlled environment.

In some configurations, the plurality of operating conditions comprise a compressor discharge temperature, an ambient temperature, an evaporator temperature, a return air temperature, a set point parameter, a condenser coil temperature, and a second evaporator temperature.

In some configurations, the system also includes a compressor discharge temperature sensor for measuring the compressor discharge temperature, an ambient air temperature sensor for measuring the ambient temperature, an evaporator coil temperature sensor for measuring the evaporator temperature, a return air temperature sensor for measuring the return air temperature, a set point temperature interface for receiving the set point parameter, a condenser coil temperature sensor for measuring the condenser coil temperature, and a second evaporator coil temperature sensor for measuring the second evaporator temperature.

In some configurations, the plurality of operating conditions comprise compressor discharge temperature, an ambient temperature, a supply air temperature, a return air temperature, and a set point parameter.

In some configurations, the system also includes a compressor discharge temperature sensor for measuring the compressor discharge temperature, an ambient air temperature sensor for measuring the ambient temperature, a supply air temperature sensor for measuring the supply air temperature, a return air temperature sensor for measuring the return air temperature, and a set point temperature interface for receiving the set point parameter.

The present disclosure also provides a method that includes determining, with a controller, whether a compressor associated with a climate-controlled environment is operating in at least one of a first mode of operation corresponding to full capacity operation and a second mode of operation corresponding to partial capacity operation. The method also includes applying, with the controller, a first model to a plurality of operating conditions associated with the climate-controlled environment when the compressor is operating in the first mode of operation to represent a loss of charge associated with the climate-controlled environment. The method also includes applying, with the controller, a second model to the plurality of operating conditions associated with the climate-controlled environment when the compressor is operating in the second mode of operation to represent the loss of charge associated with the climate-controlled environment.

In some configurations, the loss of charge comprises at least one of a percentage of refrigerant charge loss and an estimated modulation percentage of the compressor.

In some configurations, the method further includes determining, with the controller, whether the loss of charge exceeds a predefined threshold and generating, with the controller, an alert indicating the loss of charge when the loss of charge exceeds the predefined threshold.

In some configurations, the first model is a function of an evaporator temperature of an evaporator associated with the climate-controlled environment.

In some configurations, the first model is a function of a supply air temperature of supply air associated with the climate-controlled environment.

In some configurations, the plurality of operating conditions comprise a compressor discharge temperature, an ambient temperature, an evaporator temperature, a return air temperature, a set point parameter, a condenser coil temperature, and a defrost temperature.

The present disclosure includes another system that includes a plurality of sensors deployed throughout a climate-controlled environment for measuring a plurality of operating condition parameters associated with the climate-controlled environment, a compressor, and a controller. The controller receives the plurality of operating condition parameters from the plurality of sensors, determines whether the compressor is operating in at least one of a first mode of operation corresponding to full capacity operation and a second mode of operation corresponding to partial capacity operation, applies a first model to the plurality of operating condition parameters when the compressor is operating in the first mode of operation to represent a loss of charge associated with the climate-controlled environment and applies a second model to the plurality of operating condition parameters when the compressor is operating in the second mode of operation to represent the loss of charge associated with the climate-controlled environment.

In some configurations, the loss of charge comprises at least one of a percentage of refrigerant charge loss and an estimated modulation percentage of the compressor.

In some configurations, the controller determines whether the loss of charge exceeds a predefined threshold, and generates an alert indicating the loss of charge when the loss of charge exceeds the predefined threshold.

In some configurations, the first model is a function of an evaporator temperature of an evaporator associated with the climate-controlled environment.

In some configurations, the first model is a function of a supply air temperature of supply air associated with the climate-controlled environment.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible embodiments and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Loss of charge is an issue in vapor compression refrigeration and air conditioning systems. In these systems, loss of charge can lead to loss of cooling capacity and even compressor failure due to overheating. In air conditioning systems, this puts human comfort at risk. In refrigeration systems, this puts food safety at risk.

Residential air conditioning systems are typically critically charged (i.e. no refrigerant receiver) and operate at a limited set point and ambient range. Supermarket refrigeration systems also operate at a limited set point range (i.e. each compressor rack cools low temperature—frozen cases or medium temp—perishable cases). However, the ambient range can be wide and the supermarket refrigeration systems typically incorporate a receiver (i.e. are not critically charged). As a result, loss of charge methods for these applications depend on a level sensor in the receiver. In addition, loss of charge methods may just signal a gross loss of charge and do not signal the actual amount of charge in the system.

The present disclosure relates to detecting a loss of charge for a climate-controlled system. For instance, the present disclosure is directed to a process that detects a loss of charge (i.e., refrigerant charge loss) within a non-critically charged refrigeration system having a wide set point range (i.e., cools frozen and perishable goods) and ambient range. The process can also indicate the actual amount of charge in the system for full load operation. This may provide a maintenance advantage for end users that question when they get charged by a contractor to add charge to a system if the system was low on charge or if charge was really added.

As such, the present disclosure describes a system and a method to detect low charge faults within climate-control systems. For instance, the system and the method can detect low charge faults within climate-control systems utilized within an environment to prevent spoilage of food within the retail environment.

Figure 1:
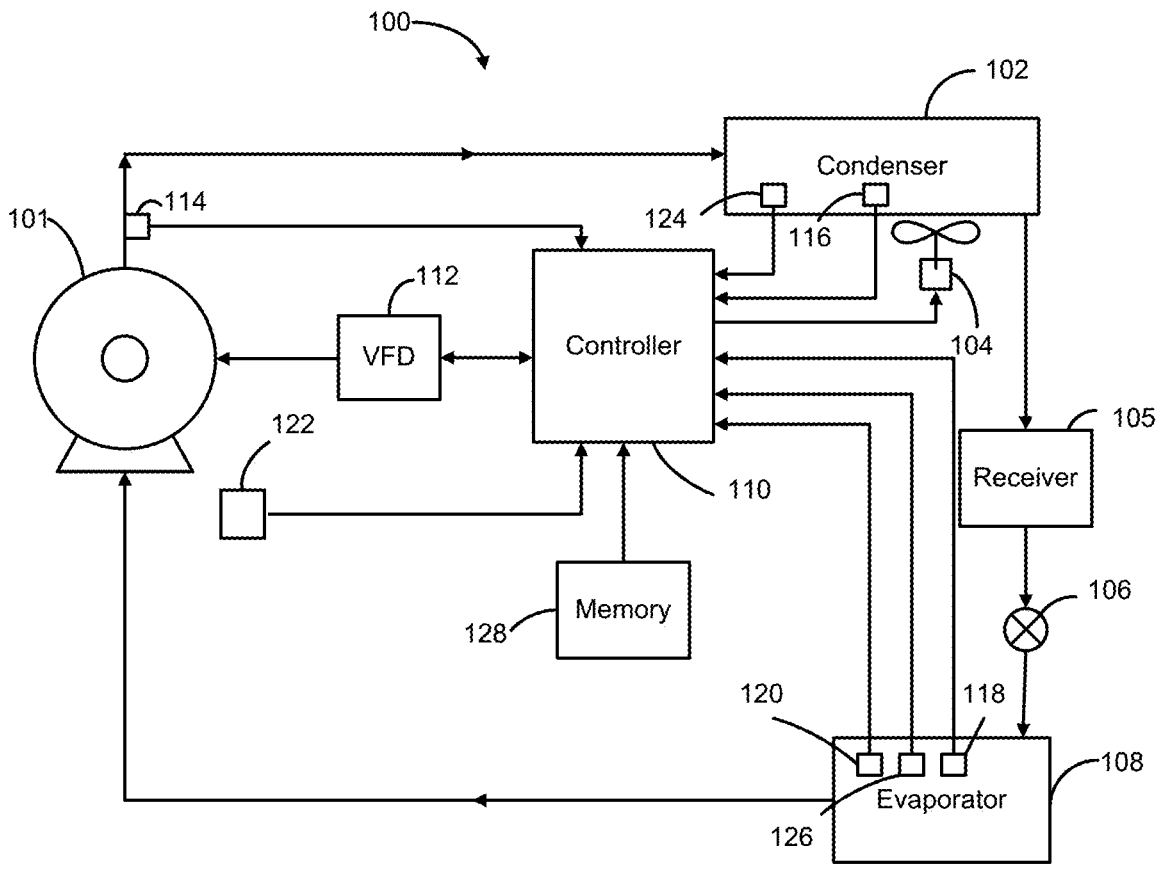
FIG. 1 is a block diagram of a climate-control system according to an example embodiment of the present disclosure.
Figure 5:
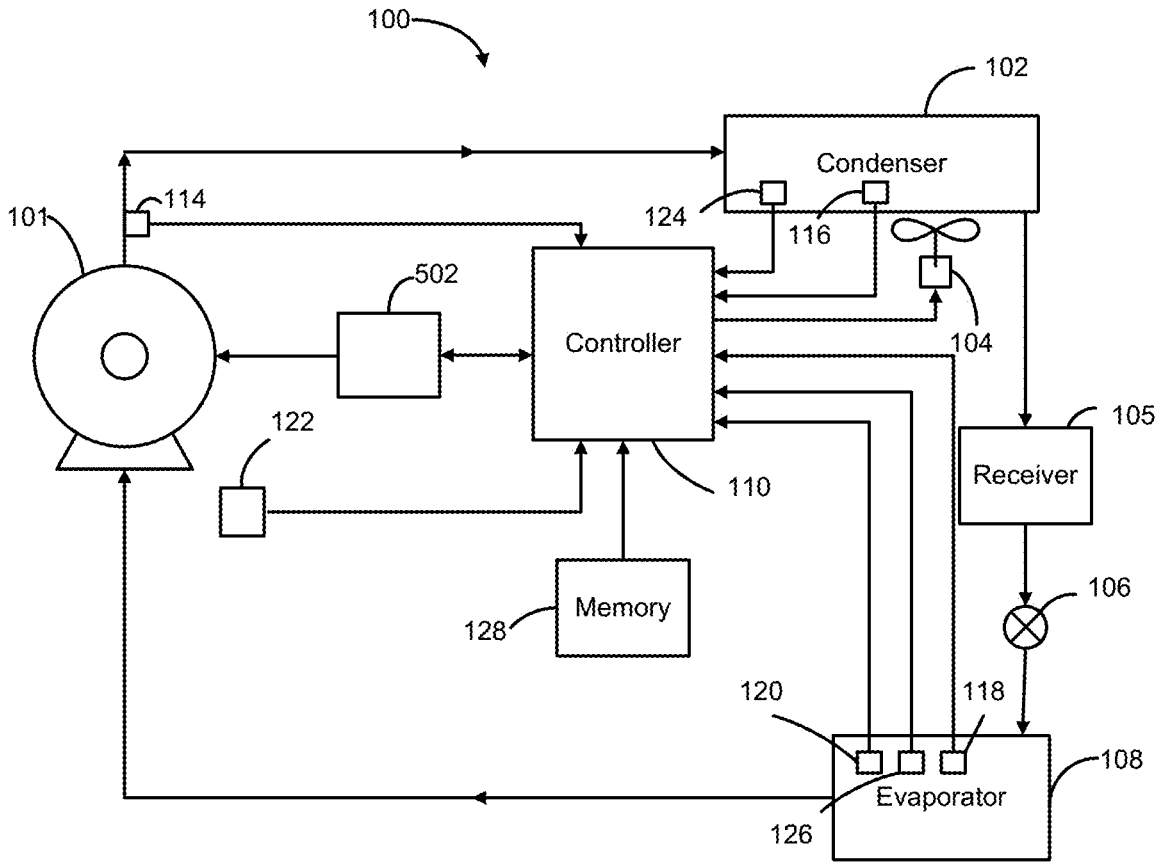
FIG. 5 is a block diagram of a climate-control system according to another example embodiment of the present disclosure.

With reference to FIG. 1, a block diagram of a climate-control system 100 according to the present disclosure is shown. The climate-control system 100 includes a compressor 101, a condenser 102 with a condenser fan 104, a receiver 105, an expansion device 106, and an evaporator 108. The climate-control system 100 also includes a controller 110 and a variable frequency drive (VFD) 112 that controls a frequency of power delivered to the compressor 101 to drive the motor of the compressor 101 at various speeds. As such, the compressor 101 with the VFD 112 may be referred to as a variable speed compressor. As discussed in further detail below, however, the present disclosure also applies to fixed speed compressors (i.e., compressors that operate at a single speed) as well as to variable-capacity compressors that utilize other capacity modulation systems. For example, as shown in FIG. 5 and discussed in further detail below, the compressor 101 can comprise a digital scroll compressor having a scroll separation system 502 modulated by the controller 110 based upon the desired temperature characteristics of the climate-controlled environment to separate the scrolls and provide reduced capacity operation.

The compressor 101 receives refrigerant vapor from the evaporator 108, compresses the refrigerant vapor, and delivers high pressure refrigerant vapor to the condenser 102. The high pressure refrigerant vapor is cooled by a condenser coil of the condenser 102 and the condenser fan 104. As the high pressure refrigerant vapor is circulated through the condenser coil, heat is rejected from the refrigerant vapor and carried away from the condenser coil by the air flow generated by the condenser fan 104. The reduction in temperature causes the refrigerant vapor to condense to a liquid refrigerant state. While a condenser 102 with a single condenser fan 104 is shown, multiple condenser fans may be used. Also, the condenser fan 104 may be a fixed speed or variable speed condenser fan.

The condenser 102 delivers liquid refrigerant to a receiver 105. Refrigerant from the receiver 105 is then delivered to the expansion device 106, which reduces the pressure of the liquid refrigerant, causing the liquid refrigerant to start to transition from the liquid state to a vapor state. The low-pressure mixture of liquid and vapor refrigerant is then delivered to the evaporator 108. A fan circulates an air flow over an evaporator coil of the evaporator 108 such that heat from the air flow is absorbed by the low-pressure mixture of liquid and vapor refrigerant. The heat absorption, combined with the decrease in pressure caused by the expansion device 106, causes the refrigerant to change state back to the vapor state. The refrigerant vapor is then delivered back to the compressor 101 and the refrigeration cycle starts anew. While FIG. 1 illustrates the climate-control system 100 as including a receiver 105, it is understood that the present disclosure may be utilized within climate-control systems that do not include a receiver (i.e., the condenser 102 delivers liquid refrigerant to the expansion device 106). Further, while FIG. 1 illustrates a single compressor 101, it is understood that the present disclosure may be utilized with a compressor rack that includes multiple compressors piped together with a common suction manifold and a common discharge manifold. Additionally, FIG. 1 illustrates a single evaporator, which may be located in a refrigeration case, such as a frozen food case or a medium temperature refrigeration case in a supermarket, for example. It is understood, however, that the climate-control system 100 may include multiple evaporators located in addition refrigeration case, such as additional frozen food cases or additional medium temperature refrigeration cases in a supermarket, for example.

The controller 110 may receive, for example, a demand for cooling based upon a set point parameter from a thermostat or another controller, such as a system controller or a case controller associated with a refrigeration case that includes the evaporator 108. Additionally or alternatively, the controller 110 may monitor a temperature within the refrigeration case, for example, and generate the demand for cooling based on a comparison of the temperature within the refrigeration case with a set point temperature. Based on the received and/or generated demand for cooling, the controller 110 may activate the compressor 101 and may communicate with the VFD 112 to operate the compressor 101 at a determined capacity percentage. For example, the controller 110 may instruct the VFD 112 to operate the compressor 101 at fifty percent capacity. In such case, the VFD 112 may control the compressor 101 to operate at a speed that is half of the full speed of the compressor 101. Additionally or alternatively, other capacity modulation systems may be used and, in such case, the controller may similarly control such capacity modulations systems to operate the compressor at an appropriate capacity to meet the demand for cooling.

Depending on the configuration of the climate-control system 100, the controller 110 can receive either a first set of operating condition parameters (see FIG. 1) or a second set of operating condition parameters (see FIG. 2) as described below. For instance, the climate-control system 100 employs multiple operating condition sensors deployed throughout the climate-control system 100 that measure one or more respective operating condition parameters described herein.

In one example, the controller 110 receives a first set of operating condition parameters (i.e., characteristics) from one or more operating condition sensors employed by the climate-control system 100. For instance, the controller 110 can receive a compressor discharge temperature representing a temperature (COMP) of the refrigerant vapor exiting the compressor 101 received from a compressor discharge temperature sensor 114. The controller 110 can also receive an ambient temperature (AMB) representing an ambient temperature of air at the condenser 102 received from an ambient air temperature sensor 116. The controller 110 can also receive an evaporator temperature (evap) representing a temperature of an evaporator coil at the evaporator 108 received from an evaporator coil temperature sensor 118. The controller 110 can also receive a return air temperature (RETURN) representing a temperature of return air at the evaporator 108 received from a return air temperature sensor 120. The controller 110 can also receive a set point parameter (set p) representing a desired temperature to maintain the climate-controlled environment at by way of the climate-control system 100 received from a set point temperature interface 122 (i.e., user interface to receive a set point value). The controller 110 can also receive a condenser coil temperature (C COIL) representing a temperature of a condenser coil of the condenser 102 received from a condenser coil temperature sensor 124. The controller 110 can also receive a second evaporator temperature representing a temperature of a second evaporator coil (i.e., defrost temperature (DEFROST)) associated with the evaporator 108 received from a second evaporator coil temperature sensor 126.

In embodiments, the controller 110 can also maintain (i.e., store) one or more baseline operating conditions associated with the climate-control system 100. The baseline operating conditions represent an expected respective operating condition value associated with the climate-control system 100 during a particular mode of operation. In one example, the controller 110 maintains the one or more baseline operating conditions within memory 128 that is communicatively connected to the controller 110. In this example, the memory 128 can maintain a baseline digital modulation parameter. The baseline digital modulation parameter represents an expected modulation percentage of the compressor. For instance, during various modes of operation, the compressor 101 operates in a digital mode that controls the modulation percentage of the compressor 101.

Figure 2:
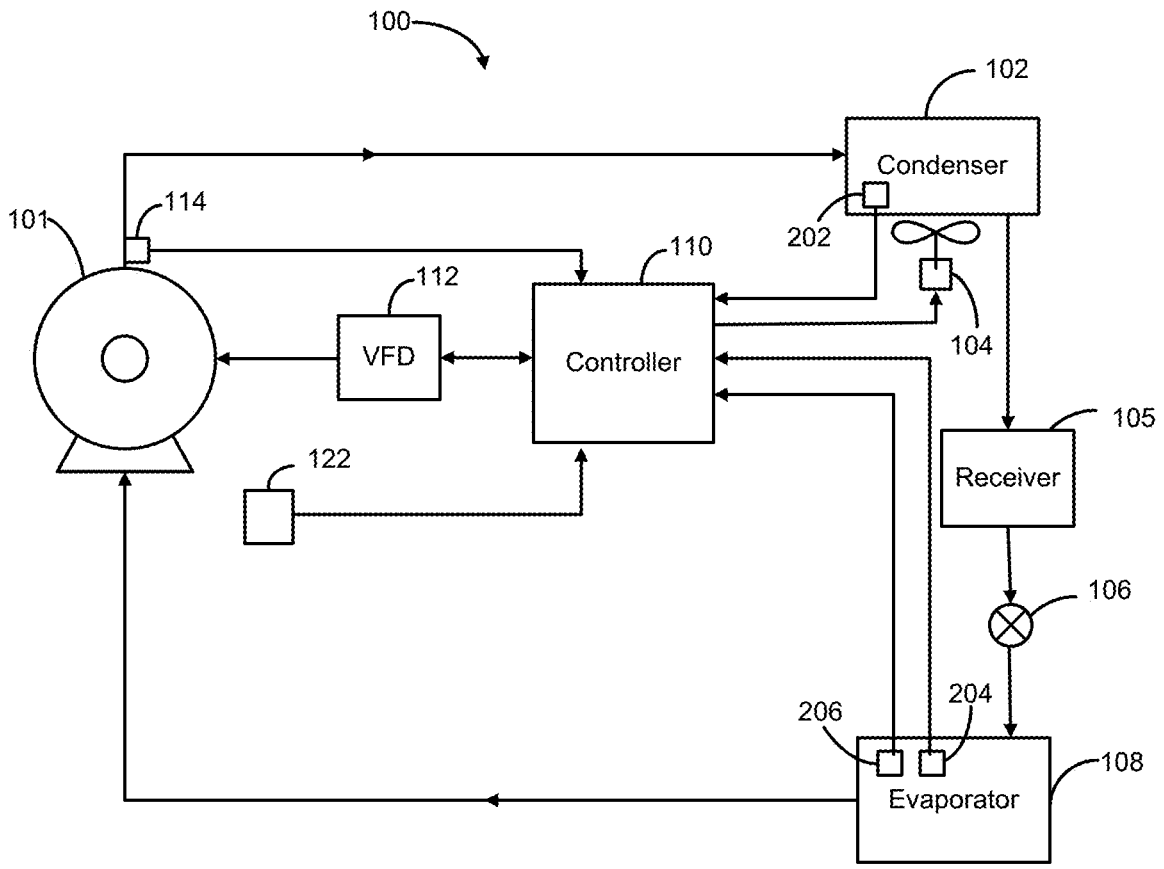
FIG. 2 is a block diagram of a climate-control system according to another example embodiment of the present disclosure.

Referring to FIG. 2, in some examples, the controller 110 receives a second set of operating condition parameters. For instance, the controller 110 can receive a compressor discharge temperature representing a temperature (COMP) of the refrigerant vapor exiting the compressor 101 received from a compressor discharge temperature sensor 114. The controller 110 can also receive an ambient temperature (AMB) representing an ambient temperature of air at the condenser 102 received from an ambient air temperature sensor 202. The controller 110 can also receive a supply air temperature representing a temperature of supply air (supply) exiting the evaporator 108 received from a supply air temperature sensor 204. The controller 110 can also receive a return air temperature (RETURN) representing a temperature of return air at the evaporator 108 received from a return air temperature sensor 206. The controller 110 can also receive a set point parameter (set p) representing a desired temperature to maintain the climate-controlled environment at by way of the climate-control system 100 received from a set point temperature interface 122.

Although a number of sensors and/or interfaces 114, 116, 118, 120, 122, 124, 126, 202, 204, 206 are shown in FIGS. 1 and 2, the controller 110 may additionally or alternatively receive operating condition data from other sources, including other controllers and/or devices associated with the climate-control system 100. For example, the controller 110 may receive operating condition data from communication with a system controller, a thermostat, a condenser fan controller, an evaporator fan controller, a refrigeration case controller, an indoor monitoring or diagnostic module, an outdoor monitoring or diagnostic module, or another suitable controller, device, and/or module associated with the climate control system 100. Compressor speed may be sensed by a speed sensor. Additionally or alternatively, compressor speed may be determined or known by the VFD 112 and communicated to the controller 110. Additionally or alternatively, compressor current, compressor voltage, and/or compressor power may be determined or known by the VFD 112 and communicated to the controller 110. The operating condition parameters (i.e., temperatures and pressures) may additionally or alternatively be calculated or derived based on other calculated, derived, or sensed data associated with the climate-control system 100.

The climate-control system 100 can detect refrigerant low charge (i.e., loss of charge) faults based upon the mode of operation of the compressor 101 of the climate-control system 100. Depending on the configuration of the climate-control system 100, the controller 110 can receive the operating condition parameters from the sensors 114, 116, 118, 120, 122, 124, 126, 202, 204, 206 as described above. Based upon the operating condition parameters, the controller 110 determines the mode of operation of the compressor 101. The controller 110 determines, based upon the operating condition parameters, whether the climate-control system 100 is operating within a first mode of operation or a second mode of operation.

The controller 110 determines that the climate-control system 100 is operating in a first mode of operation when the controller 110 determines that the climate-control system 100 is providing a maximum amount of cooling to the environment (i.e., the climate-control system 100 is operating in a full load mode of operation). For instance, the first mode of operation can include the compressor 101 operating continuously (i.e., at one-hundred percent (100%) capacity, which would include full speed in the case of a variable speed compressor, for example). Thus, the compressor 101 can determine whether there has been a loss of charge associated with the climate-control system 100 (i.e., the climate-controlled environment for which the climate-control system 100 is modifying) by monitoring changes in the operating condition parameters and the estimated loss of charge. As discussed in further detail below, the controller 110 determines that the climate-control system 100 is operating in a second mode of operation when the controller 110 determines that the climate-control system 100 is providing a modulated (or less than the maximum) amount of cooling to the environment (i.e., the climate-control system 100 is operating in a partial or reduced load mode of operation).

When the controller 110 is operating in the first mode of operation, the controller 110 applies (i.e., utilizes) models set forth below to the received operating condition parameters to determine whether the climate-control system 100 is experiencing a loss of charge. Depending upon the configuration of the climate-control system 100, the controller 110 receives the first set of operating condition parameters from respective sensors 114, 116, 118, 120, 122, 124, 126, or receives the second set of operating condition parameters from respective sensors 114, 122, 202, 204, 206.

In one example, the controller 110 utilizes the following model (i.e., equation) to characterize the loss of charge when the controller 110 receives the first set of operating condition parameters (and is operating in the first mode of operation):

(1) Percentage=a*(COMP−AMB)^2exp(−b/(c*(COMP−AMB))^(d+e*(evap−setp)*(COMP−AMB))), where a, b, c, d, and e are variables associated with the climate-control system 100. For example, a may be 0.006551731024899, b may be 2787, c may be 0.0156180488510027, d may be 1.57400179756816, and e may be 0.0132248135106744.

The percentage may be normalized to a final/maximum removed charge value. For instance, during a low charge test, if the maximum removal was seven pounds (7 lb.) and a given charge removal step (i.e., there is only three and a half pounds (3.5 lb.) removed), then the current loss of charge percentage at that step is 100*(7−3.5)/7=50%

In another example, when the climate-control system 100 is operating in a first mode of operation and the controller 110 receives the second set of operating condition parameters, the controller 110 utilizes the following model to characterize the loss of charge:

$$\text{Percentage}=f*\exp(-g*h\hat{}(i*(\text{COMP}-\text{AMB})-(i*(\text{COMP}-\text{AMB}))\hat{}(j\hat{}(\text{supply}-\text{setp})))), \quad (2)$$

where f, g, h, i, and j are variables associated with the climate-control system 100. For example, f may be 101.711987976774, g may be 10407.6335808234, h may be 0.837924998328986, i may be 0.567311696881907, and j may be 0.504871597345269.

Additionally, in some embodiments, the controller 110 can utilize one or more other models, as described herein, to determine an estimated percentage of refrigerant charge loss when the set point parameter of the climate-control system 100 is greater than or equal to thirty degrees Fahrenheit (30° F.).

In another example, when the climate-control system 100 is operating in a first mode of operation and the controller 110 receives the second set of operating condition parameters, the controller 110 can also model the behavior of the climate-control system 100 utilizing the following model when the set point parameter of the climate-control system 100 is below thirty degrees Fahrenheit (30° F.):

$$\text{Percentage}=k*(\text{COMP}-\text{AMB})*\exp(-l*\exp(\exp(m-n*(\text{COMP}-\text{AMB}))-(\text{supply}-\text{setp}))), \quad (3)$$

where k, l, m, and n are variables associated with the climate-control system 100. For example, k may be 0.775979696058062, l may be 0.000212056799787806, m may be 77.1672416080415, and n may be 0.833347471090585.

Additionally, when the climate-control system 100 is operating in a first mode of operation and the controller 110 receives the second set of operating condition parameters, the controller 110 can model the behavior of the climate-control system 100 utilizing the following model when the set point parameter of the climate-control system 100 is greater than or equal to thirty degrees Fahrenheit (30° F.):

$$\text{Percentage}=o*\text{RETURN}*(\text{COMP}-\text{AMB})*p\hat{}((q+r\hat{}(\text{supply}-\text{setp}))\hat{}\text{sqrt}((\text{COMP}-\text{AMB})*\text{sqrt}(s*(\text{supply}-\text{setp})\hat{}2))), \quad (4)$$

where o, p, q, r, and s are variables associated with the climate-control system 100. For example, o may be 0.00929967168491112, p may be 3.15432519967851e-16, q may be 2.39066447669313e-16, r may be 6.96566349168468e-17, and s may be 2.49399460073684e-9.

The models described above can be utilized by the controller 110 when the climate-control system 100 is operating in a first mode of operation to model a refrigerant charge loss (i.e., loss of charge) within the climate-control system 100. The respective models (i.e., models (1), (2), (3), (4)) are a function of the evaporator temperature (i.e., model (1)) or a function of the supply air temperature (i.e., models (2), (3), (4)).

The controller 110 utilizes model (1) when the climate-control system 100 is configured such that the controller 110 receives the first set of operating condition parameters. Additionally, the controller 110 utilizes models (2), (3), and/or (4) when the climate-control system 100 is configured such that the controller 110 receives the second set of operating condition parameters. If the estimated percentage of refrigerant charge loss exceeds a predefined threshold, the controller 110 generates and transmits an alert to indicate the refrigerant charge loss within the climate-control system 100.

The controller 110, upon utilizing the models described above, can determine the percentage of refrigerant charge loss within the climate-control system 100. Thus, the controller 110, based upon this determination, can determine an estimated refrigerant charge remaining within the climate-control system 100. Thus, the controller 110 can also generate an alert indicating the amount of refrigerant charge remaining within the climate-control system 100.

As described above, the controller 110 utilizes model (3) when the set point parameter of the climate-control system 100 is less than thirty degrees Fahrenheit (30° F.), and the controller 110 utilizes model (4) when the set point parameter of the climate-control system 100 is greater than or equal to thirty degrees Fahrenheit (30° F.).

In various embodiments, the controller 110 determines that the climate-control system 100 is operating in a second mode of operation when the controller 110 determines that the climate-control system 100 is providing a modulated amount of cooling to the environment (i.e., the climate-control system 100 is operating in a partial load mode of operation). For instance, the second mode of operation can include the compressor 101 operating at a fraction of its full capacity, such as a fraction of its full speed in the case of a variable speed compressor. In various embodiments, the fraction at which the compressor 101 operates depends upon the set point and/or the environmental factors associated with the climate-control system 100. For example, as shown in FIG. 5, in various embodiments, the compressor 101 comprises a digital scroll compressor having a scroll separation system 502 modulated by the controller 110 based upon the desired temperature characteristics of the climate-controlled environment to separate the scrolls and provide reduced capacity operation.

When the controller 110 is operating in the second mode of operation (i.e., the partial mode of operation), the controller 110 can also apply various models, depending upon the configuration of the climate-control system 100, to the received operating condition parameters to determine whether the climate-control system 100 is experiencing a refrigerant charge loss. In embodiments, the compressor 101 is operating in a digital mode of operation to control the modulation percentage of the compressor 101.

To determine which model to utilize for applying to the various operating condition parameters, the controller 110 determines whether the set point parameter of the climate-control system 100 is greater than or equal to thirty degrees Fahrenheit (30° F.) or whether the set point parameter of the climate-control system 100 is less than thirty degrees Fahrenheit (30° F.). When the controller 110 determines that the set point parameter of the climate-control system 100 is greater than or equal to thirty degrees Fahrenheit (30° F.), the controller 110 utilizes the following model to characterize the loss of charge:

$$\text{ModPct}=t+u*\text{RETURN}+v*(C\ \text{COIL})+x*\text{DEFROST}\hat{}2-y*\text{setp}-z*\text{DEFROST}-aa*\text{RETURN}*\text{DEFROST}, \quad (5)$$

where t, u, v, w, x, y, z and aa are variables associated with the climate-control system 100. For example, t may be 35.3565908928647, u may be 12.8604615055966, v may be 0.190637173839511, x may be 0.152878033676559, y may be 4.21928743505772, z may be 9.86243216998838, and aa may be 0.146067571579208.

ModPct represents the estimated modulation percentage of the compressor 101 based upon the measured operating parameters described above. The controller 110 compares the actual ModPct to the estimated ModPct. If the controller 110 determines the comparison deviates beyond a defined threshold value (i.e., the actual ModPct exceeds two percent (2%) of the estimated ModPct, the actual ModPct exceeds five percent (5%) of the estimated ModPct, etc.), the controller 110 determines that a potential refrigerant charge loss has occurred (or is occurring). In this event, the controller 110 can generate an alert to indicate that a potential refrigerant charge loss has occurred (or is occurring). In this instance, model (5) is a function to the DEFROST variable that at least partially causes the modulation percentage of the compressor 101.

When the controller 110 determines that the set point parameter of the climate-control system 100 is less than thirty degrees Fahrenheit (30° F.), the controller 110 utilizes the following model to characterize the loss of charge:

$$\text{Percentage}=bb+cc*(\text{duty cycle})\hat{}2+dd*(\text{duty cycle})*(C\ \text{COIL})\hat{}2+ee*(\text{comp}-\text{amb})*(\text{duty cycle})\hat{}2-ff*(\text{comp}-\text{amb})-gg*(C\ \text{COIL})*(\text{duty cycle}\ \%)-hh*(\text{duty cycle}\ \%)\hat{}3, \quad (6)(a)$$

where bb, cc, dd, ee, ff, gg, and hh are variables associated with the climate-control system 100. For example, bb may be 63.7916510112538, cc may be 0.135210384979607, dd may be 0.000593446157224709, ee may be 5.99564456191957e-5, ff may be 0.194971439988616, gg may be 0.10791240956478, and hh may be 0.000877581760862546.

In some embodiments, when the controller 110 determines that the set point parameter of the climate-control system 100 is less than thirty degrees Fahrenheit (30° F.), the controller 110 utilizes the following model to characterize the loss of charge:

$$\text{Percentage}=ii+jj*\text{Return}+kk*(\text{duty cycle})+ll*(\text{supply}-\text{setp})+-mm/(\text{comp}-\text{amb})-nn*(\text{duty cycle}\ \%)*\text{Return}-oo*(\text{duty cycle})\hat{}2, \quad (6)(b)$$

where ii, jj, kk, ll, mm, nn, and oo are variables associated with the climate-control system 100. For example, ii may be 53.9607236901606, jj may be 4.75624195322439, kk may be 1.76199737552502, ll may be 0.464119594992767, mm may be 2457.7965183579, nn may be 0.0531899705351627, and oo may be 0.0125922436501002.

In some embodiments, the controller 110 determines that the set point parameter of the climate-control system 100 is less than thirty degrees Fahrenheit (30° F.), the controller 110 utilizes the following model to characterize the loss of charge:

$$\text{Percentage}=(pp*(\text{duty cycle})+qq*(\text{supply}-\text{set}p)+rr*(\text{supply}-\text{set}p)\hat{}3-ss-tt*\text{RETURN}-uu*(\text{duty cycle})\hat{}2-vv*(\text{supply}-\text{set}p)\hat{}2-ww*(\text{duty cycle})*\text{RETURN}\hat{}2), \quad (7)$$

where pp, qq, rr, ss, tt, uu, vv, ww are variables associated with the climate-control system 100. For example, pp may be 6.77047668115042, qq may be 0.716846881363248, rr may be 0.0380231941206524, ss may be 468.139096945102, tt may be 19.6927678608128, uu may be 0.0380231941206524, vv may be 0.0380231941206524 and ww may be 0.00585899586889394.

Percentage represents the estimated percentage of refrigerant charge loss. Thus, the controller 110 utilizes model (6)(a), model (6)(b), and/or model (7) to determine an estimated percentage loss of charge. The controller 110 can determine whether the estimated percentage of refrigerant charge loss exceeds a predefined threshold. If the estimated percentage does exceed a predefined threshold, the controller 110 generates and transmits an alert to indicate the refrigerant charge loss within the climate-control system 100. In these instances, model (6)(a), model (6)(b), and/or model (7) are a function of the duty cycle of the climate-control system 100.

When the controller 110 determines that the set point parameter of the climate-control system 100 is greater than or equal to thirty degrees Fahrenheit (30° F.), the controller 110 utilizes the following model to characterize the loss of charge:

$$\text{Percentage}=\text{MAX}(\text{ModPct Model (5), First Mode of Operation Model (2)}) \quad (8)$$

For instance, the controller 110 may apply Model (5) when the controller 110 receives the first set of operating condition parameters and the compressor 101 is operating in a second mode of operation. In another instance, the controller may apply Model (2) when the controller receives the second set of operating condition parameters and the compressor is operating in the second mode of operation.

In high loss of charge situations, the climate-control system 100 can attempt to compensate for charge loss by modifying (i.e., increasing) the modulation percentage. Thus, in these situations, the climate-control system 100 may be operating in a near-first mode of operation (i.e., the climate-control system 100 is nearly operating at full load). As such, model (8) can be utilized to determine an estimated percentage of refrigerant charge loss.

Figure 3:
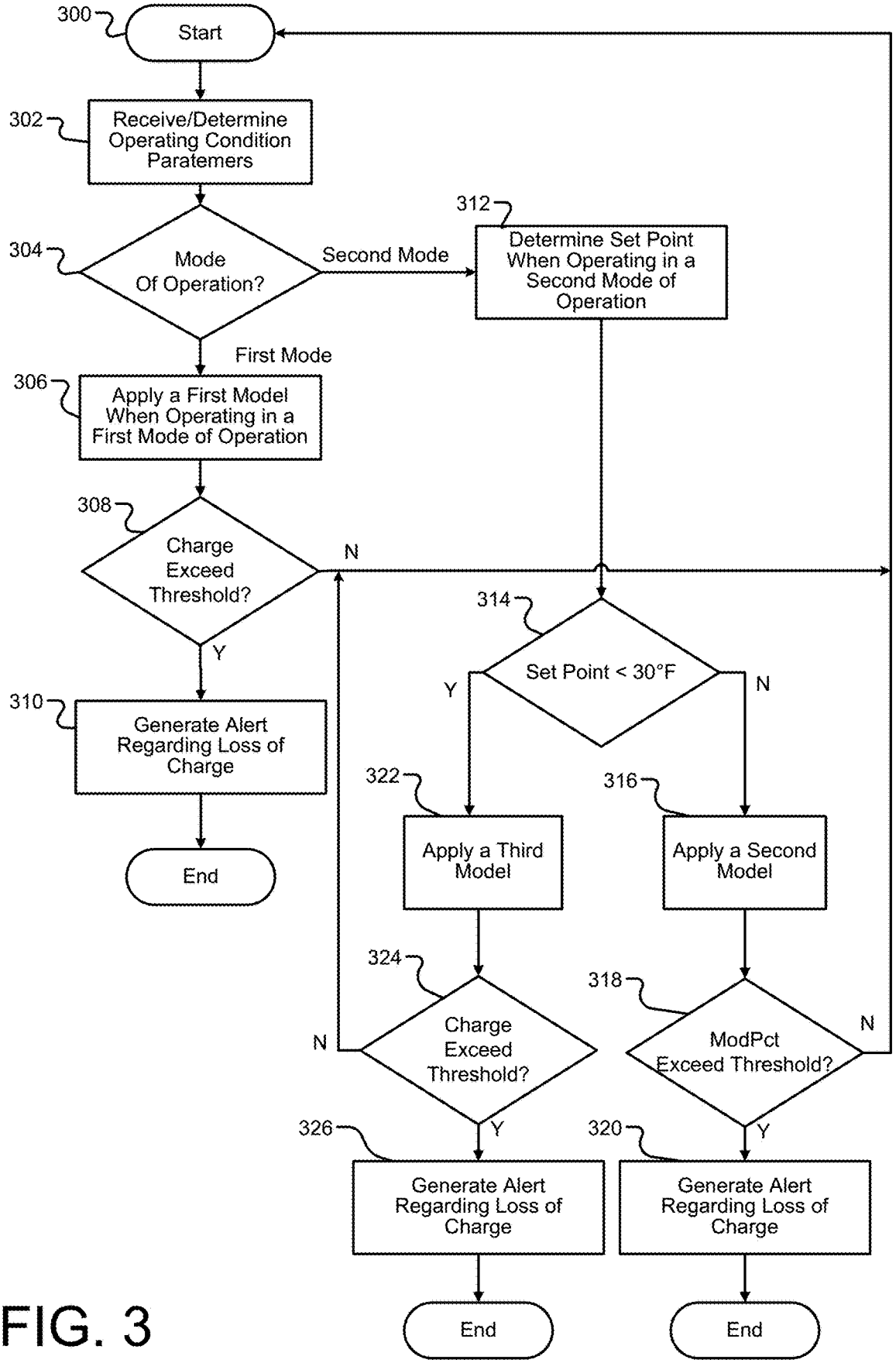
FIG. 3 is a flow chart for loss of charge detection method according to the present disclosure.

With reference to FIG. 3, a flow chart for detecting whether a climate-control system 100 is experiencing refrigerant charge loss (e.g., loss of charge) according to the present disclosure is shown. In this embodiment, the flow chart illustrates an example method in which the climate-control system 100 employs sensors 114, 116, 118, 120, 122, 126, 128 to measure a first set of operating condition parameters. The method may be performed by the controller 110. Additionally or alternatively, the method may be performed by another controller, device, or module. For example, the method may be performed by a system controller, a controller associated with the VFD 112, or another suitable controller, device, or module. The method starts at 300.

At 302, the controller 110 receives and/or determines the operating condition data. For example, the controller 110 may receive the operating condition parameters (i.e., temperatures and pressures), including COMP, AMB, evap, RETURN, set p, C COIL, and/or DEFROST, from the various sensors and/or interfaces 114, 116, 118, 120, 122, 126, 128. Additionally or alternatively, the controller 110 may calculate or derive one or more of the operating condition parameters, such as operation condition temperatures and pressures (COMP, AMB, evap, RETURN, set p, C COIL, and/or DEFROST).

At 304, the controller 110 determines a mode of operation of the compressor 101. For instance, the controller 110 determines whether the compressor 101 is operating in a first mode of operation (i.e., full load) or is operating in a second mode of operation (i.e., partial load). At 304, when the controller 110 determines that the compressor is operating in the first mode of operation, the controller 110 proceeds to 306. At 306, the controller 110 applies a first model, such as model (1), to the respective operating condition data when the controller 110 determines the compressor 101 is operating in the first mode of operation to estimate a percentage of refrigerant charge loss.

At 308, the controller 110 determines whether estimated percentage of refrigerant charge loss exceeds a predefined threshold. If the estimated percentage of refrigerant charge loss exceeds a predefined threshold, the controller 110 generates and transmits an alert (i.e., to a client computing device) to indicate the refrigerant charge loss within the climate-control system 100 at 310. If the estimated percentage of refrigerant charge loss does not exceed a predefined threshold, the method transitions to 300 for continual monitoring of the climate-control system 100.

At 312, when the controller 110 determines the compressor 101 is operating in a second mode of operation (i.e., partial load), the controller 110 determines the set point parameter of the climate-control system 100. At 314, the controller 110 determines whether the set point parameter of the climate-control system 100 is greater than or equal to thirty degrees Fahrenheit (30° F.). If the controller 110 determines the set point parameter of the climate-control system 100 is greater than or equal to thirty degrees Fahrenheit (30° F.), the controller 110 applies a second model, such as model (5), to the respective operating condition data to estimate a modulation percentage of the compressor 101 at 316.

At 318, the controller 110 compares the estimated modulation percentage (ModPct) with the actual modulation percentage and determines whether actual modulation percentage deviates (i.e., exceeds) beyond a defined threshold value (i.e., the actual ModPct exceeds two percent (2%) of the estimated ModPct, the actual ModPct exceeds five percent (5%) of the estimated ModPct, etc.). If the controller 110 determines that the actual modulation percentage exceeds a threshold from the estimated modulation percentage, the controller 110 determines that a potential refrigerant charge loss has occurred (or is occurring). At 320, the controller 110 generates an alert to indicate that a potential refrigerant charge loss has occurred (or is occurring) when the estimated modulation percentage exceeds the defined threshold. Otherwise, the method transitions to 300 for continual monitoring of the climate-control system 100.

At 322, when the set point parameter of the climate-control system 100 is less than thirty degrees Fahrenheit (30° F.), the controller 110 applies a third model, such as model (6), to the respective operating condition data to estimate a percentage of refrigerant loss.

At 324, the controller 110 determines whether the estimated percentage of refrigerant charge loss exceeds a predefined threshold. At 326, the controller 110 generates an alert to indicate that a potential refrigerant charge loss has occurred (or is occurring) when the percentage of refrigerant charge loss exceeds the predefined threshold. Otherwise, the method transitions to 300 for continual monitoring of the climate-control system 100.

Figure 4A:
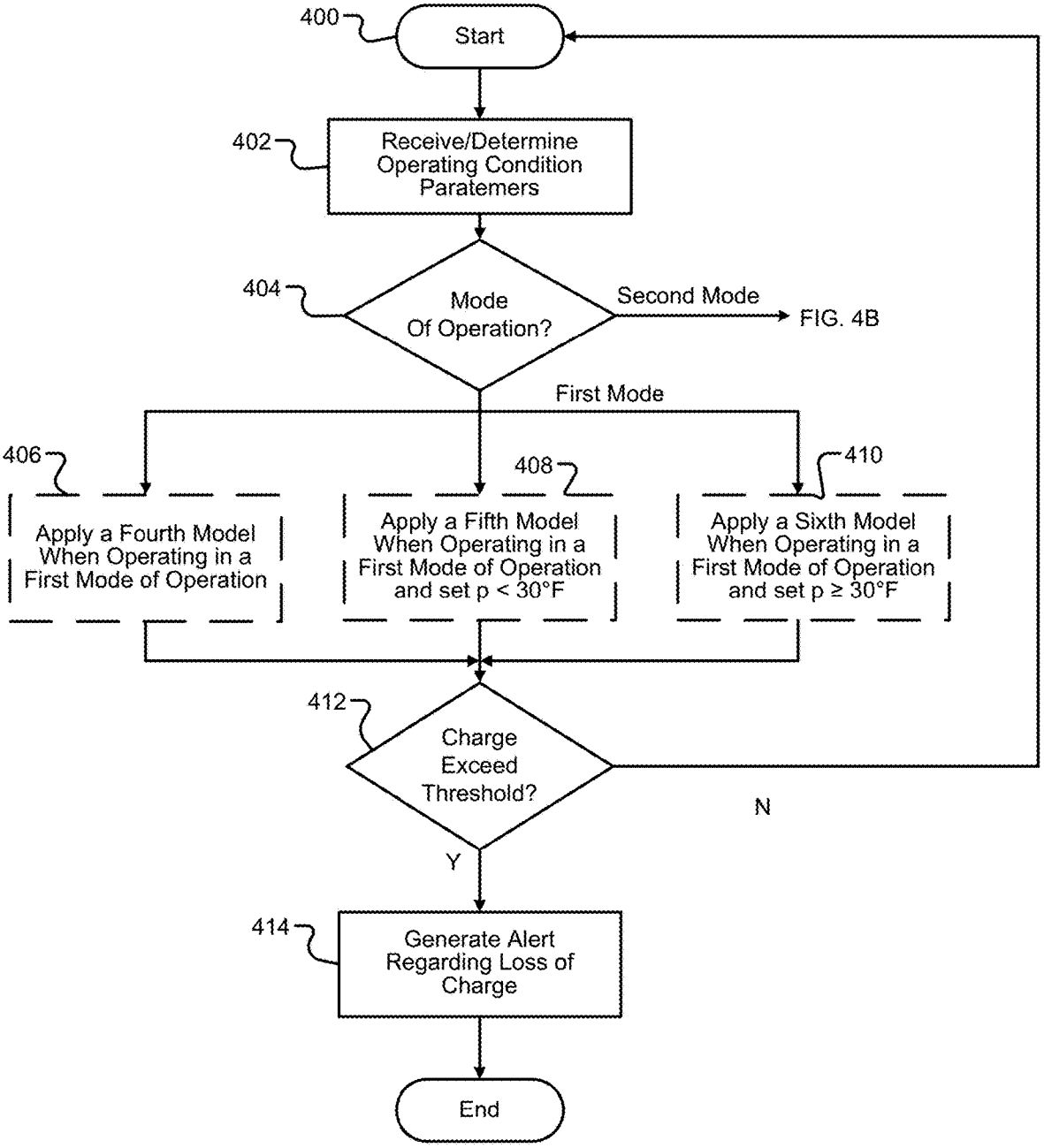
FIG. 4A is a flow chart for a loss of charge detection method according to the present disclosure.
Figure 4B:
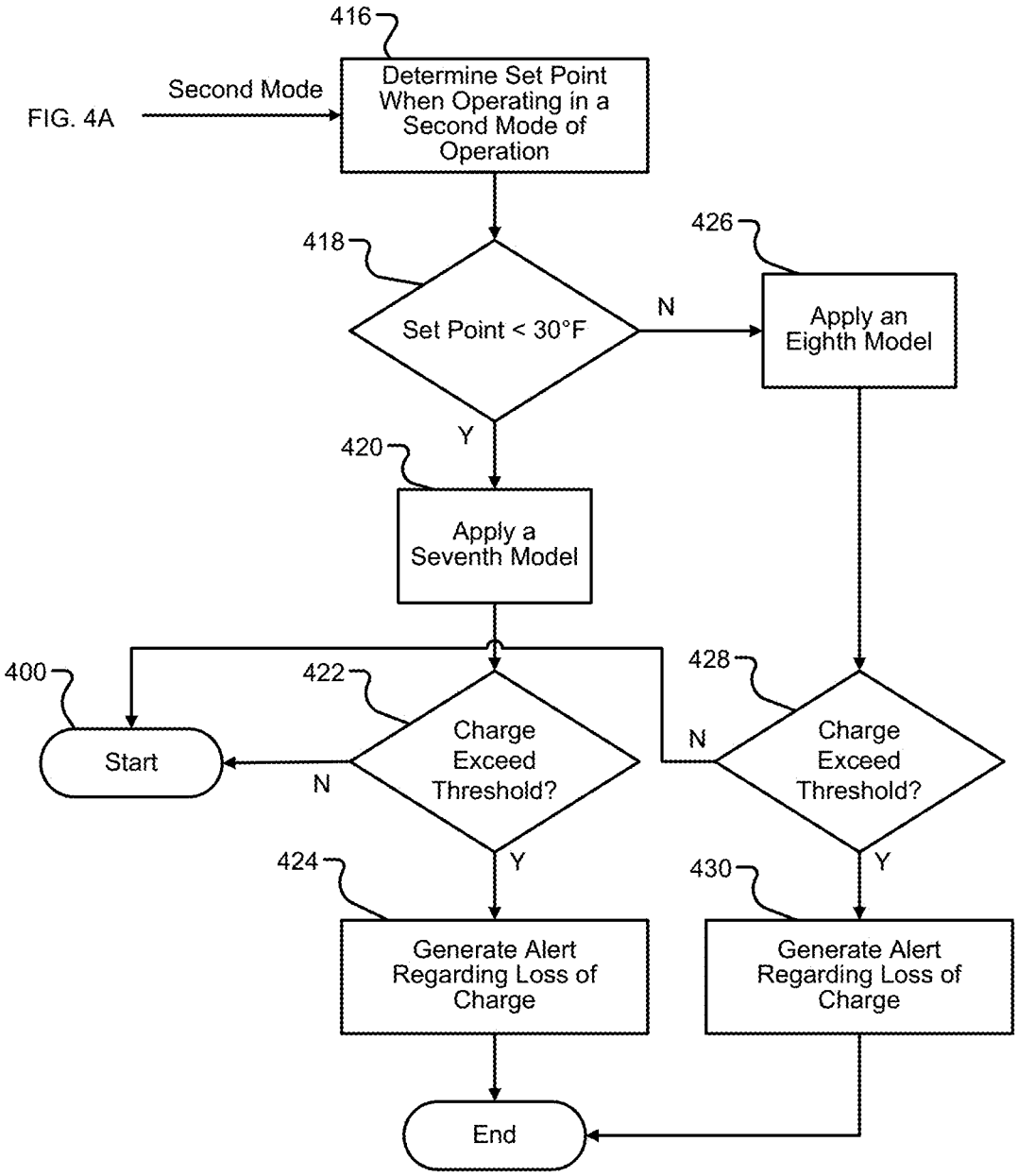
FIG. 4B is a flow chart for a loss of charge detection method according to the present disclosure

With reference to FIGS. 4A and 4B, a flow chart for detecting whether a climate-control system 100 is experiencing refrigerant charge loss according to the present disclosure is shown. In this embodiment, the flow chart illustrates an example method in which the climate-control system 100 employs sensors 122, 124, 202, 204, 206 to measure a second set of operating condition parameters. The method may be performed by the controller 110. Additionally or alternatively, the method may be performed by another controller, device, or module. For example, the method may be performed by a system controller, a controller associated with the VFD 112, or another suitable controller, device, or module. The method starts at 400.

At 402, the controller 110 receives and/or determines the operating condition data. For example, the controller 110 may receive the operating condition parameters (i.e., temperatures and pressures), including COMP, AMB, supply, RETURN, and set p, from the various sensors and/or interfaces 122, 124, 202, 204, 206. Additionally or alternatively, the controller 110 may calculate or derive one or more of the operating condition temperatures and pressures (COMP, AMB, supply, RETURN, and set p) as discussed in detail above.

At 404, the controller 110 determines a mode of operation of the compressor 101. Depending upon the configuration of the climate-control system 100, the controller 110 may transition to 406 to apply a model to estimate a percentage of refrigerant charge loss. Otherwise, in other configurations, the controller 110 may transition to 408 or to 410 to apply a respective model (depending upon the set point parameter) to estimate a percentage of refrigerant charge loss. However, in other configurations, the controller 110 may estimate the percentage of refrigerant charge loss by utilizing the models associated with 406 and 408 or 410 (depending upon the set point parameter described below). For instance, the controller 110 determines whether the compressor 101 is operating in a first mode of operation (i.e., full load) or is operating in a second mode of operation (i.e., partial load). In some embodiments, at 406, the controller 110 can apply a fourth model, such as model (2), to the respective operating condition data when the controller 110 determines the compressor 101 is operating in the first mode of operation to estimate a percentage of refrigerant charge loss.

In other embodiments, the controller 110 determines whether set point parameter of the climate-control system 100 is below thirty degrees Fahrenheit (30° F.). At 408, when the controller 110 determines that the climate-control system 100 is below thirty degrees Fahrenheit (30° F.), the controller 110 applies a fifth model, such as model (3), to the respective operating condition data to estimate a percentage of refrigerant charge loss.

Yet, in other embodiments, at 410, the controller 110 determines that the set point parameter of the climate-control system 100 is greater than or equal thirty degrees Fahrenheit (30° F.) and applies a sixth model, such as model (4), to the respective operating condition data to estimate a percentage of refrigerant charge loss.

At 412, the controller 110 determines whether estimated percentage of refrigerant charge loss exceeds a predefined threshold. If the estimated percentage of refrigerant charge loss exceeds a predefined threshold, the controller 110 generates and transmits an alert (i.e., to a client computing device) to indicate the refrigerant charge loss within the climate-control system 100 at 414. If the estimated percentage of refrigerant charge loss does not exceed a predefined threshold, the method transitions to 400 for continual monitoring of the climate-control system 100.

At 416, when the controller 110 determines the compressor 101 is operating in a second mode of operation (i.e., partial load), the controller 110 determines the set point parameter of the climate-control system 100. At 418, the controller 110 determines whether the set point parameter is less than thirty degrees Fahrenheit (30° F.). At 420, the controller 110 applies a seventh model, such as model (7), to the respective operating condition data to estimate a percentage of refrigerant loss when the set point parameter is less than thirty degrees Fahrenheit (30° F.).

At 422, the controller 110 determines whether the estimated percentage of refrigerant charge loss exceeds a predefined threshold. At 424, the controller 110 generates an alert to indicate that a potential refrigerant charge loss has occurred (or is occurring) when the percentage of refrigerant charge loss exceeds the predefined threshold. Otherwise, the method transitions to 400 for continual monitoring of the climate-control system 100.

At 426, the controller 110 determines the set point parameter is greater than or equal to thirty degrees Fahrenheit (30° F.). At 428, the controller 110 applies an eighth model, such as model (8), to the respective operating condition data to estimate a percentage of refrigerant loss when the set point parameter is greater than or equal to thirty degrees Fahrenheit (30° F.).

At 428, the controller 110 determines whether the estimated percentage of refrigerant charge loss exceeds a predefined threshold. At 430, the controller 110 generates an alert to indicate that a potential refrigerant charge loss has occurred (or is occurring) when the percentage of refrigerant charge loss exceeds the predefined threshold. Otherwise, the method transitions to 400 for continual monitoring of the climate-control system 100.

In some embodiments of the present disclosure, data generated by the controller 110 can be transmitted to another computing device via a communication network for analysis. For instance, the controller 110 can cause the data generated by the controller 110 to be transmitted to another computing device (e.g., a client device, a server, etc.), a cloud network, and the like, for analysis purposes.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (i.e., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the FIGS. Spatially relative terms may be intended to encompass different orientations of the device in use or operation in addition to the orientation depicted in the FIGS. For example, if the device in the FIGS is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

In this application, including the definitions below, the term module may be replaced with the term circuit. The term module may refer to, be part of, or include an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor (shared, dedicated, or group) that executes code; memory (shared, dedicated, or group) that stores code executed by a processor; other suitable hardware components that provide the described functionality; or a combination of some or all of the above, such as in a system-on-chip.

The term code, as used above, may include software, firmware, and/or microcode, and may refer to programs, routines, functions, classes, and/or objects. The term shared processor encompasses a single processor that executes some or all code from multiple modules. The term group processor encompasses a processor that, in combination with additional processors, executes some or all code from one or more modules. The term shared memory encompasses a single memory that stores some or all code from multiple modules. The term group memory encompasses a memory that, in combination with additional memories, stores some or all code from one or more modules. The term memory may be a subset of the term computer-readable medium. The term computer-readable medium does not encompass transitory electrical and electromagnetic signals propagating through a medium, and may therefore be considered tangible and non-transitory. Non-limiting examples of a non-transitory tangible computer readable medium include nonvolatile memory, volatile memory, magnetic storage, and optical storage.

The apparatuses and methods described in this application may be partially or fully implemented by one or more computer programs executed by one or more processors. The computer programs include processor-executable instructions that are stored on at least one non-transitory tangible computer readable medium. The computer programs may also include and/or rely on stored data.

What is claimed is:

1. A system comprising:

a compressor; and a controller configured to (i) receive a plurality of operating condition parameters associated with a climate-controlled environment including a set point temperature for the climate-controlled environment, (ii) determine whether the compressor is operating in a first mode of operation corresponding to full capacity operation or in a second mode of operation corresponding to partial capacity operation, (iii) apply a first model to the plurality of operating condition parameters to determine a loss of charge associated with the climate-controlled environment when the compressor is operating in the first mode of operation, (iv) apply a second model to the plurality of operating condition parameters to determine the loss of charge associated with the climate-controlled environment when the compressor is operating in the second mode of operation and the set point temperature is less than a predetermined temperature threshold, and (v) apply a third model to the plurality of operating condition parameters to determine the loss of charge associated with the climate-controlled environment when the compressor is operating in the second mode of operation and the set point temperature is not less than the predetermined temperature threshold;

wherein the first model, the second model, and the third model each represent the loss of charge as a function of at least one operating condition parameter of the plurality of operating condition parameters.

2. The system of claim 1, wherein the controller is further configured to determine whether the loss of charge exceeds a predefined charge threshold and to generate an alert indicating the loss of charge when the loss of charge exceeds the predefined charge threshold.

3. The system of claim 1, wherein the predetermined temperature threshold is thirty degrees Fahrenheit.

4. The system of claim 1, wherein the plurality of operating condition parameters include at least one of a compressor discharge temperature, an ambient temperature, a supply air temperature of air exiting an evaporator connected to the compressor, and a return air temperature of air entering the evaporator.

5. The system of claim 4, further comprising: a compressor discharge temperature sensor configured to measure the compressor discharge temperature; an ambient air temperature sensor configured to measure the ambient temperature; a supply air temperature sensor configured to measure the supply air temperature; a return air temperature sensor configured to measure the return air temperature; and a set point temperature interface configured to receive the set point temperature.

6. A method comprising:

receiving, with a controller that controls a compressor associated with a climate-controlled environment, a plurality of operating condition parameters associated with the climate-controlled environment including a set point temperature for the climate-controlled environment;

determining, with the controller, whether the compressor is operating in a first mode of operation corresponding to full capacity operation or in a second mode of operation corresponding to partial capacity operation;

applying, with the controller, a first model to the plurality of operating condition parameters to determine a loss of charge associated with the climate-controlled environment when the compressor is operating in the first mode of operation;

applying, with the controller, a second model to the plurality of operating condition parameters to determine the loss of charge associated with the climate-controlled environment when the compressor is operating in the second mode of operation and the set point temperature is less than a predetermined temperature threshold; and applying, with the controller, a third model to the plurality of operating condition parameters to determine the loss of charge associated with the climate-controlled environment when the compressor is operating in the second mode of operation and the set point temperature is not less than the predetermined temperature threshold;

wherein the first model, the second model, and the third model each represent the loss of charge as a function of at least one operating condition parameter of the plurality of operating condition parameters.

7. The method of claim 6, further comprising:

determining, with the controller, whether the loss of charge exceeds a predefined charge threshold; and generating, with the controller, an alert indicating the loss of charge when the loss of charge exceeds the predefined charge threshold.

8. The method of claim 6, wherein the predetermined temperature threshold is thirty degrees Fahrenheit.

9. The method of claim 6, wherein the plurality of operating condition parameters include at least one of a compressor discharge temperature, an ambient temperature, a supply air temperature of air exiting an evaporator connected to the compressor, and a return air temperature of air entering the evaporator.

10. The method of claim 9, further comprising:

receiving, with the controller, the compressor discharge temperature from a compressor discharge temperature sensor configured to measure the compressor discharge temperature;

receiving, with the controller, the ambient temperature from an ambient air temperature sensor configured to measure the ambient temperature;

receiving, with the controller, the supply air temperature from a supply air temperature sensor configured to measure the supply air temperature;

receiving, with the controller, the return air temperature from a return air temperature sensor configured to measure the return air temperature; and receiving, with the controller, the set point temperature from a set point temperature interface configured to receive the set point temperature.

11. A system comprising:

a compressor; and a controller configured to (i) receive a plurality of operating condition parameters associated with a climate-controlled environment including a set point temperature for the climate-controlled environment, (ii) determine whether the compressor is operating in a first mode of operation corresponding to full capacity operation or in a second mode of operation corresponding to partial capacity operation, (iii) determine whether the set point temperature is less than a predetermined temperature threshold, (iv) apply a first model to the plurality of operating condition parameters to determine a loss of charge associated with the climate-controlled environment when the compressor is operating in the first mode of operation and the set point temperature is less than the predetermined temperature threshold, (v) apply a second model to the plurality of operating condition parameters to determine the loss of charge associated with the climate-controlled environment when the compressor is operating in the first mode of operation and the set point temperature is not less than the predetermined temperature threshold, (vi) apply a third model to the plurality of operating condition parameters to determine the loss of charge associated with the climate-controlled environment when the compressor is operating in the second mode of operation and the set point temperature is less than the predetermined temperature threshold, and (vii) apply a fourth model to the plurality of operating condition parameters to determine the loss of charge associated with the climate-controlled environment when the compressor is operating in the second mode of operation and the set point temperature is not less than the predetermined temperature threshold, wherein the first model, the second model, the third model, and the fourth model each represent the loss of charge as a function of at least one operating condition parameter of the plurality of operating condition parameters.

12. The system of claim 11, wherein the controller is further configured to determine whether the loss of charge exceeds a predefined charge threshold and to generate an alert indicating the loss of charge when the loss of charge exceeds the predefined charge threshold.

13. The system of claim 11, wherein the predetermined temperature threshold is thirty degrees Fahrenheit.

14. The system of claim 11, wherein the plurality of operating condition parameters include at least one of a compressor discharge temperature, an ambient temperature, a supply air temperature of air exiting an evaporator connected to the compressor, and a return air temperature of air entering the evaporator.

15. The system of claim 14, further comprising: a compressor discharge temperature sensor configured to measure the compressor discharge temperature; an ambient air temperature sensor configured to measure the ambient temperature; a supply air temperature sensor configured to measure the supply air temperature; a return air temperature sensor configured to measure the return air temperature; and a set point temperature interface configured to receive the set point temperature.

16. A method comprising:

receiving, with a controller that controls a compressor associated with a climate-controlled environment, a plurality of operating condition parameters associated with the climate-controlled environment including a set point temperature for the climate-controlled environment;

determining, with the controller, whether the compressor is operating in a first mode of operation corresponding to full capacity operation or in a second mode of operation corresponding to partial capacity operation;

determining, with the controller, whether the set point temperature is less than a predetermined temperature threshold;

applying, with the controller, a first model to the plurality of operating condition parameters to determine a loss of charge associated with the climate-controlled environment when the compressor is operating in the first mode of operation and the set point temperature is less than the predetermined temperature threshold;

applying, with the controller, a second model to the plurality of operating condition parameters to determine the loss of charge associated with the climate-controlled environment when the compressor is operating in the first mode of operation and the set point temperature is not less than the predetermined temperature threshold;

applying, with the controller, a third model to the plurality of operating condition parameters to determine a loss of charge associated with the climate-controlled environment when the compressor is operating in the second mode of operation and the set point temperature is less than the predetermined temperature threshold; and applying, with the controller, a fourth model to the plurality of operating condition parameters to determine a loss of charge associated with the climate-controlled environment when the compressor is operating in the second mode of operation and the set point temperature is not less than the predetermined temperature threshold;

wherein the first model, the second model, the third model, and the fourth model each represent the loss of charge as a function of at least one operating condition parameter of the plurality of operating condition parameters.

17. The method of claim 16, further comprising:

determining, with the controller, whether the loss of charge exceeds a predefined charge threshold; and generating, with the controller, an alert indicating the loss of charge when the loss of charge exceeds the predefined charge threshold.

18. The method of claim 16, wherein the predetermined temperature threshold is thirty degrees Fahrenheit.

19. The method of claim 16, wherein the plurality of operating condition parameters include at least one of a compressor discharge temperature, an ambient temperature, a supply air temperature of air exiting an evaporator connected to the compressor, and a return air temperature of air entering the evaporator.

20. The method of claim 19, further comprising:

receiving, with the controller, the compressor discharge temperature from a compressor discharge temperature sensor configured to measure the compressor discharge temperature;

receiving, with the controller, the ambient temperature from an ambient air temperature sensor configured to measure the ambient temperature;

receiving, with the controller, the supply air temperature from a supply air temperature sensor configured to measure the supply air temperature;

receiving, with the controller, the return air temperature from a return air temperature sensor configured to measure the return air temperature; and receiving, with the controller, the set point temperature from a set point temperature interface configured to receive the set point temperature.

* * * * *